US006862853B1

(12) United States Patent
Visser

(10) Patent No.: US 6,862,853 B1
(45) Date of Patent: Mar. 8, 2005

(54) SYSTEM AND METHOD FOR FACILITATING THE PRESENTATION OF INVENTORY ITEMS

(75) Inventor: Barney D. Visser, Denver, CO (US)

(73) Assignee: Furniture Row USA, LLC, Denver, CO (US)

( * ) Notice: Subject to any disclaimer, the term of this patent is extended or adjusted under 35 U.S.C. 154(b) by 981 days.

(21) Appl. No.: 08/851,040

(22) Filed: May 5, 1997

(51) Int. Cl.[7] ..... E04H 1/04
(52) U.S. Cl. ..... 52/234; 52/169.1; 52/236.3
(58) Field of Search ..... 52/234, 236.1, 52/33

(56) References Cited

U.S. PATENT DOCUMENTS

| | | | | |
|---|---|---|---|---|
| 1,040,411 A | | 10/1912 | Raymond | |
| 1,096,960 A | | 5/1914 | Seeberger | |
| 2,435,044 A | | 1/1948 | Lewis et al. | 186/1 |
| 2,804,191 A | | 8/1957 | King | 198/76 |
| 3,185,108 A | | 5/1965 | Muller | 104/25 |
| 3,399,758 A | | 9/1968 | Karr | 198/181 |
| 3,696,805 A | * | 10/1972 | Sweeten et al. | 52/234 X |
| 3,732,649 A | * | 5/1973 | Mehran | 52/234 X |
| 3,757,420 A | | 9/1973 | Silverman | 32/22 |
| 4,154,027 A | * | 5/1979 | Searcy | 52/234 X |
| 4,259,816 A | * | 4/1981 | Bergquist | 52/236.1 X |
| 4,299,321 A | | 11/1981 | Hermawan | 198/321 |
| 4,901,482 A | * | 2/1990 | Lockard et al. | 52/33 |
| 4,928,452 A | * | 5/1990 | Sacks | 52/236.3 |
| 5,775,033 A | * | 7/1998 | Meehan | 52/33 |
| 5,806,260 A | * | 9/1998 | Quaintance | 52/236.3 |

* cited by examiner

*Primary Examiner*—Richard Chilcot
(74) *Attorney, Agent, or Firm*—Townsend and Townsend and Crew LLP

(57) ABSTRACT

The invention provides systems, structures and methods which facilitate the display of inventory items. In one exemplary embodiment, the invention provides a system which comprises a plurality of separate stores. An elongate wall separates each of the stores. Additionally, each wall is provided with a doorway, with the doorways of each wall being aligned with each other. An aisle passes through each doorway such that a customer may visualize at least some of the interior of each store while standing in the aisle and looking down the aisle.

18 Claims, 8 Drawing Sheets

INVENTORY TYPES

GROUP A
BED MATTRESSES

GROUP B
WOOD BEDROOM FURNITURE
- HEADBOARDS
- CHESTS
- ARMOIRES
- NIGHTSTANDS

GROUP C
OAK FURNITURE
- DINING
- OFFICE
- ENTERTAINMENT

GROUP D
LIVING ROOM/FAMILY ROOM FURNITURE
- SOFAS
- RECLINERS
- COFFEE TABLES
- LAMPS

FIG. 1

SYSTEM AND METHOD FOR FACILITATING THE PRESENTATION OF INVENTORY ITEMS

BACKGROUND OF THE INVENTION

This invention relates generally to the field of retail sales and marketing, and particularly to the organization and arrangement of merchandise items to facilitate their display and sale. More specifically, the invention provides systems, structures and methods for physically segregating items of different types while maximizing both physical and visual access to each of the item types.

In the modern retail environment, customers desire to select their purchases from a wide variety of merchandise items. At the same time, customers desire to have such items all in close proximity. Evidence of this fact is found throughout the United States where the most popular shopping environments are malls, strip malls, and the like.

Most malls in the United States have a small number of relatively large department stores and numerous smaller specialty stores. Typically, spacious hallways run along the outside of the specialty stores and terminate at the entrances to the department stores. Such hallways are the "arteries" of the mall and provide customers with a convenient external access to the specialty stores and the department stores. Although most department stores will also have their own external entrances, the specialty stores will typically provide external access to customers only through the hallways.

Conventional department stores, such as Dillards, Macy's and the like, have a wide assortment of items under a single roof. The items are typically organized into randomly arranged "departments." The boundaries of such "departments" are typically defined by an aisle or by a separate floor within the building.

The typical strip mall includes several specialty stores which are built adjacent each other. A sidewalk usually runs past the front entrance to each of the stores. In this way, once a customer has finished shopping in one store, she may exit the store, walk outside along the sidewalk, and enter into another store.

Such malls and strip malls as described above suffer from a number of serious drawbacks. For example, many malls have included such a vast number of stores that it is impractical to browse through every store in a single shopping trip. Indeed, the walking distance between all of the stores can easily exceed one-half of a mile in many of the larger malls. To even the most hearty of shoppers, this can make the shopping experience inconvenient and frustrating. Furthermore, since a single external hallway typically interconnects each of the stores, shopping traffic can become congested and make access to the stores difficult.

The arrangement of most department stores can also make the shopping experience frustrating. The "departments" are typically highly fractionized so that finding a particular item may entail searching through various "departments" which are usually poorly marked and are scattered about the store, often on separate floors.

A significant drawback to strip malls is that the merchandise usually differs vastly from store to store. For example, one store may be a pet store, the next a bagel store, and the next a video store. Hence, a customer shopping for a particular group of retail items, such as various household items, may have to visit several strip malls to find the appropriate stores. Another drawback to such strip malls is that a customer must leave a store and walk outside in order to enter another store. This can be especially inconvenient during inclement weather or when shopping with children.

Hence, it would be desirable to provide customers with a wide variety of merchandise items while overcoming or greatly reducing the drawbacks associated with previously proposed retailing schemes. In particular, it would be desirable to have items of different types segregated and clearly organized to allow customers to easily locate a desired item. Further, it would be desirable if physical access to each type of item were optimized to allow customers to conveniently access and browse through a particular group of items.

SUMMARY OF THE INVENTION

The invention provides systems, structures and methods for facilitating the presentation of inventory items and for providing access to the items. In one embodiment, an exemplary system is provided which comprises a plurality of separate stores. An elongate wall separates each of the stores, with each wall having at least one doorway. The doorways are aligned with each other, and an aisle passes through each doorway to allow a customer to visualize at least some of the interior of each store while standing in the aisle and looking down the aisle. In this manner, the customer can rapidly gain visual access into the interior of each store while standing in the aisle to facilitate the selection of a particular store.

In one exemplary aspect of the system, the walls are configured so that they generally prevent the visualization of the items within adjacent stores when the customer is away from the aisle. In this manner, once a customer has selected a given store and begins browsing through the store, the, customer's vision will be focused on the particular type of items within the selected store. In this way, the customer will not be distracted by other types of inventory items which are not presently of particular interest.

In another aspect, each store includes four outer walls. Such walls are preferably orthogonal to each other; however, other orientations may be possible. Each store will preferably further include at least one outside entrance to provide customers an external entrance to each of the stores from a parking lot.

In another particular aspect, each store includes items of a particular type which are unique to the store. Such an arrangement facilitates the finding of particular items since a customer will know that each store includes only items which are unique to that store.

In still another particular aspect, each wall includes a pair of doorways, and the aisle circuits through each store while passing through the doorways. In this manner, a customer may circuit about the periphery of each store to conveniently access the items within each store. In yet another aspect, each of the stores are independently managed. In this way, each store may be managed according to its own business practices, while obtaining benefit from adjacent stores by being interconnected by the internal doorways. Optionally, each doorway may be provided with a door that may be closed to prevent access to the stores from within the stores. In this way, the stores may be kept separate when needed, such as after regular business hours. In still yet another aspect, a warehouse is preferably connected to at least some of the stores to provide a supply of extra inventory items for purchase or display.

The invention further provides an exemplary system for visually displaying unique groups of inventory items. The system comprises an outer structure having a set of outer walls which define an interior. A plurality of elongate dividers are provided with the interior to divide the interior into separate stores. Each of the dividers includes at least one opening to allow customers to pass through each of the stores. Further, each store includes a unique group of inventory items, and the dividers are arranged such that a customer when within the interior can generally visualize only one of the unique groups of items at any given location within the interior. Such a system is advantageous in that it prevents the customer from visualizing other groups of items when within a particular store. In this way, the customer may focus her attention on items of a specific type to facilitate the discovery of a desired item. In this way, shopping time can be greatly reduced since a customer can quickly focus her search once a particular group of items has been identified.

For example, such unique groups may include, bed mattresses, wood bedroom furniture, oak furniture, living room furniture and the like. With this arrangement, a customer searching for a bed mattress need look in only one store to quickly locate the desired item. If the customer also wishes to shop for various related items, such as a bedroom set, the customer simply walks to the next store through the interior opening to access wood bedroom furniture.

To facilitate location of the different groups of items, the openings are preferably aligned with each other to allow the customer to view at least some of the interior of each store when looking down an aisle.

The invention further provides an exemplary building for housing groups of inventory items. The building comprises an outer structure which defines an interior. A plurality of elongate dividers are provided within the interior to divide the interior into separate stores. Each divider further includes a pair of openings, and an aisle is provided which circuits the interior and passes through each of the openings. In this way, a customer may walk along the aisle to rapidly circuit through each of the stores.

Preferably, each store includes a unique group of inventory items to facilitate the location of specific items. Further, each pair of openings are preferably aligned with other pairs of openings to allow the customer to view at least some of the interior of each store when looking down the aisle. When within a desired store, the customer may walk off the aisle, with the walls generally preventing the visualization of the items within adjacent stores.

The invention further provides an exemplary method for presenting inventory items. According to the method, a plurality of stores are provided which are separated from each other by elongate walls. Each of the walls has a doorway, and the doorways are aligned with each other. With this arrangement, the customer stands in an aisle which passes through each doorway and looks down the aisle to visualize at least some of the interior of each store. In this way, from one location the customer may see at least a portion of each of the stores so that the customer can rapidly identify the store of interest.

Once within a desired store, the customer walks away from the aisle and visually scans the inventory of items from within the store. As the customer is scanning the store, the visualization of the inventory items in the other stores is substantially prevented by the walls. In this way, the customer may focus her attention only on the items which are of interest.

In one aspect of the method, the walls have a pair of doorways, and the aisle circuits through each store while passing through the doorways. This allows the customer to walk the length of the aisle to circuit through the building to quickly scan the items within each building. Preferably, each store includes a unique group of inventory items to allow the customer to quickly identify which store will have a desired item.

In another exemplary embodiment, the invention provides a method for enhancing display space within a building. According to the method, a building is provided which comprises a set of outer walls which define an interior. The building is divided into a plurality of separate stores by placing a plurality of dividers within the interior. Each divider includes at least one opening to allow customers to pass through each of the stores along an aisle. Each store is supplied with a unique group of inventory items. In this way, the customer walks through each of the stores, with the dividers being arranged such that generally only one of the unique group of items can be visualized at any given location within the interior when off the aisle.

In a preferable aspect, the dividers have a pair of openings and an aisle which circuits through each of the openings. In this way, the customer may circuit through the interior along the aisle. Further, while standing in the aisle, the customer is able to look the length of the aisle to visualize at least part of the interior of each store. In another aspect, the customer may enter each of the stores through an outside entrance. In this way, the customer may park within a parking lot, enter into one of the stores and then circuit through the interior of each store along the aisle.

BRIEF DESCRIPTION OF THE DRAWINGS

FIG. 1 sets forth various unique types of inventory items that may be placed into the separate stores of the invention.

DETAILED DESCRIPTION OF THE SPECIFIC EMBODIMENTS

Figure 2:
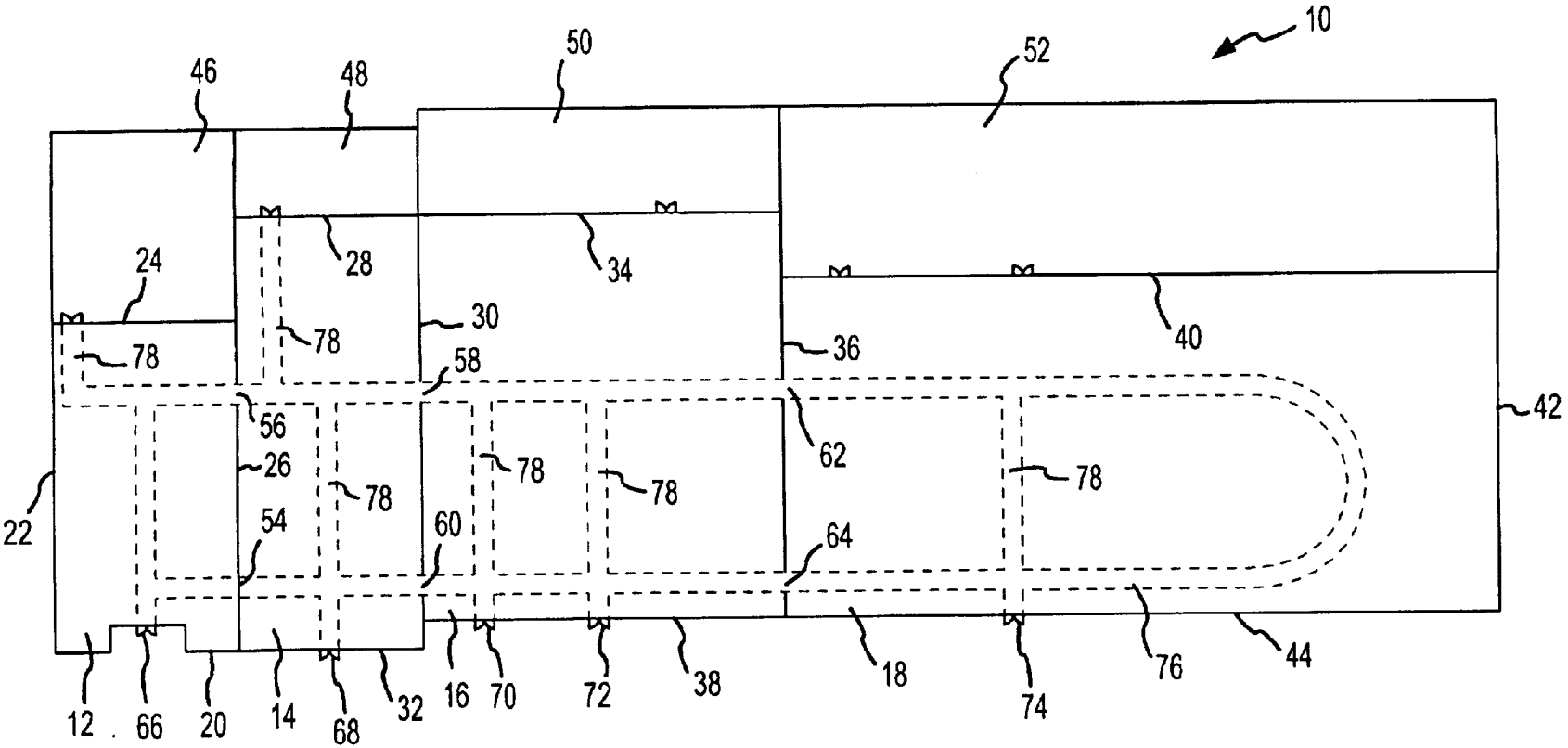
FIG. 2 is a top view of an exemplary floor plan of a building housing a plurality of separate stores according to the invention.

The invention provides systems, structures and methods which facilitate the presentation of various types of inventory items. To display various types of inventory items, the invention provides a plurality of separate stores which are adjacent each other. The stores are physically separated from each other by a wall, divider or the like as described in greater detail hereinafter. Optionally, the stores may also be separate from each other by being independently managed and/or owned.

The types of items in each store will preferably be unique to each store to allow a customer to easily a locate a desired item by simply knowing the item type and the particular store carrying that type of item. By way of illustration and example, various types of inventory items are set forth in FIG. 1. For convenience of discussion, the inventory types have been placed into different groups, with the understanding that each group would be included within a separate store. As shown in FIG. 1, Group A comprises bed mattresses. Hence, the store carrying bed mattresses would carry only that type of item. Group B comprises wood bedroom furniture, such as headboards, chests, armoirs, nightstands and the like. However, the store carrying the items in Group B would not have bed mattresses since those would be limited to the store carrying Group A. Group C comprises oak furniture, such as oak dining room furniture, oak office furniture, oak entertainment centers, and the like. Group D comprises living room/family room furniture. These items may include, for example, sofas, recliners, coffee tables, lamps, associated accessories, and the like. It will be appreciated that the items in Groups A–D are by way of example and other types of groups are possible including carpets, hardware, home repairs, building materials, appliances, and the like.

By grouping the inventory items in this manner, each store will be provided with a unique set of items to facilitate the customers' access to a particular type of item. Moreover, competition between the stores is limited since each store will carry only unique types of items.

Although each store will carry a unique group of items, in some cases it will be desirable to have the groups also be somewhat related. For example, each group in FIG. 1 may be categorized as household and office furnishings. Having each group related in this manner is advantageous in that a customer who is interested in furnishing a house need only proceed to one building which will include separate stores having items useful in furnishing the house. Moreover, by segregating the items into groups, the location of a particular item type will be greatly facilitated.

As described above, each of the stores are structurally separated from each other. However, another important feature of the invention is that the structure used to physically separate each of the stores will have at least one opening, such as a doorway, to allow a customer to browse through each of the stores without having to leave the building and enter separately into each store through an exterior doorway. This provides convenience to the customer and reduces shopping time since access to each store is made readily available. At the same time, the stores are physically separated from each other to allow the stores to be independently managed and/or owned.

One particularly important feature of the invention is the manner in which the interior passageways between each of the stores are fashioned to allow intra-access to each of the stores. Preferably, the entrances or passageways between the stores will be aligned with each other. An aisle is also provided which passes axially through each of the passages. In this way, a customer may stand in the aisle and look down the aisle to view at least a portion of each of the stores. In this manner, a customer will easily be able to see the unique types of items in each of the stores and be able to quickly select the desired store.

Moreover, the passageways between the stores are preferably configured such that once the customer walks off the aisle to browse through the selected store, the walls separating the stores will prevent the customer from viewing the items in adjacent stores. In this manner, the customer's attention is focused only on the items within the desired store so that the customer's attention will not be distracted.

Visual access to the items in adjacent stores is limited or altogether prevented by configuring the passageways to be sized in a manner such that when the customer walks off the aisle the customer will generally be prevented from viewing into the interior of an adjacent store. At the same time, the passageways are made sufficiently large so that when standing in the aisle and looking down the aisle, the customer will be able to view at least part of the interior of each store so as to more easily select the desired store. By way of example, stores having a width of about 150 ft. to about 250 ft. will typically have a passageway having a width in the range from about 6 ft. to about 20 ft. (the width of the aisle) and more preferably from about 12 ft. to about 16 ft., and a height in the range from about 8 ft. to about 14 ft.

In another particularly preferable aspect, each store will be at approximately the same level to facilitate the customer's view when looking down the aisle. Also, doors, gates, or the like may be provided for each passageway to allow the stores to be completely separated from each other when closed. Such a feature is particularly useful when the stores are separately managed and/or owned to allow the stores to be sealed off from each other when the stores are closed to customers.

One important alternative feature of the invention is that each wall separating the stores may be provided with a pair of passageways which are spaced apart from each other. Further, the passageways in each wall will preferably be aligned with the passageways in each adjacent wall. In this way, a track (or main aisle) may be provided to circuit through the interior of each of the stores. Such a configuration facilitates the flow of customers through each of the stores. In this way, a customer may conveniently go from store to store by simply entering onto the main aisle and then walking along the aisle through each of the stores. Optionally, "mini-aisles" may branch off from the main aisle to allow convenient access to the items when within a particular store. Although the interior of each of the stores may be configured according to the particular owner's wishes, in some cases it will be preferable to keep the interior generally open. In this manner, as the customer walks along the main aisle the customer will be able to easily scan the entire set of inventory items within the store. In turn, this will facilitate the location of a desired item.

Referring now to FIG. 2, an exemplary embodiment of a building 10 having a plurality of separate stores 12, 14, 16 and 18 will be described. Each of the stores is defined by four walls. For example, store 12 is defined by walls 20, 22, 24 and 26. Store 14 is defined by walls 26, 28, 30 and 32. Store 16 is defined by walls 30, 34, 36 and 38. Store 18 is defined by walls 36, 40, 42, and 44. Preferably, each of the walls will extend to a ceiling or roof over building 10, or at least high enough to prevent a person from looking or climbing over the wall. Conveniently, at the rear of each store are warehouses 46, 48, 50 and 52 for storing inventory items for each of the stores.

As shown, walls 26, 30 and 36 each include a pair of openings 54, 56, 58, 60, 62 and 64 which allow customers to move between each store without exiting building 10. Conveniently, each store is also provided with at least one exterior entranceway 66, 68, 70, 72, and 74. In this way, a customer may enter building 10 through any of the exterior entrances and then browse through each of the stores by walking through openings 54–64.

Conveniently, a main aisle 76 is provided and passes through each of the openings 54–64 to circuit through the interior of stores 12–18. Optionally, various "mini-aisles" 78 may be provided to branch off from main aisle 76 to facilitate access to items within each of stores 12–18.

Although shown with a pair of openings for walls 26, 30 and 36, it will be appreciated that a single opening (or more than two openings) may be provided for each wall. The openings in each wall will preferably be aligned with the openings in adjacent walls to allow a customer to look down main aisle 76 to view at least part of the interior of each store 12–18. In this manner, a customer is allowed to view the types of inventory held in each store when on the main aisle. Upon selection of a desired store, a customer may simply walk along main aisle 76 to enter the desired store. The customer may then exit main aisle 76 and walk along various mini-aisles 78 to locate a particular item.

Openings 54–64 will preferably be configured so that when a customer looks down main aisle 76 the customer will be able to view at least some of the interior of each store 12–18. Further, when exiting main aisle 76, openings 54–64 will preferably be sized so that visual access to an adjacent store through openings 54–64 will generally be prevented. In this way, once the customer is within a desired store, the customer's attention will be focused only on the items within that store. By way of example, for stores having a width of at least about 150 ft., openings 54–64 will preferably have a width in the range from about 6 ft. to about 20 ft. (corresponding to the width of main aisle 76) and more preferably from about 12 ft. to about 16 ft., and a height in the range from about 8 ft. to about 14 ft.

The walls separating the stores from each other and separating the stores from the warehouses will preferably be opaque to prevent visual access into adjacent stores or the warehouses. Optionally, walls 20, 32, 38 and 44 may be provided with windows to allow visual access in and out of each store through these walls.

Figure 3:
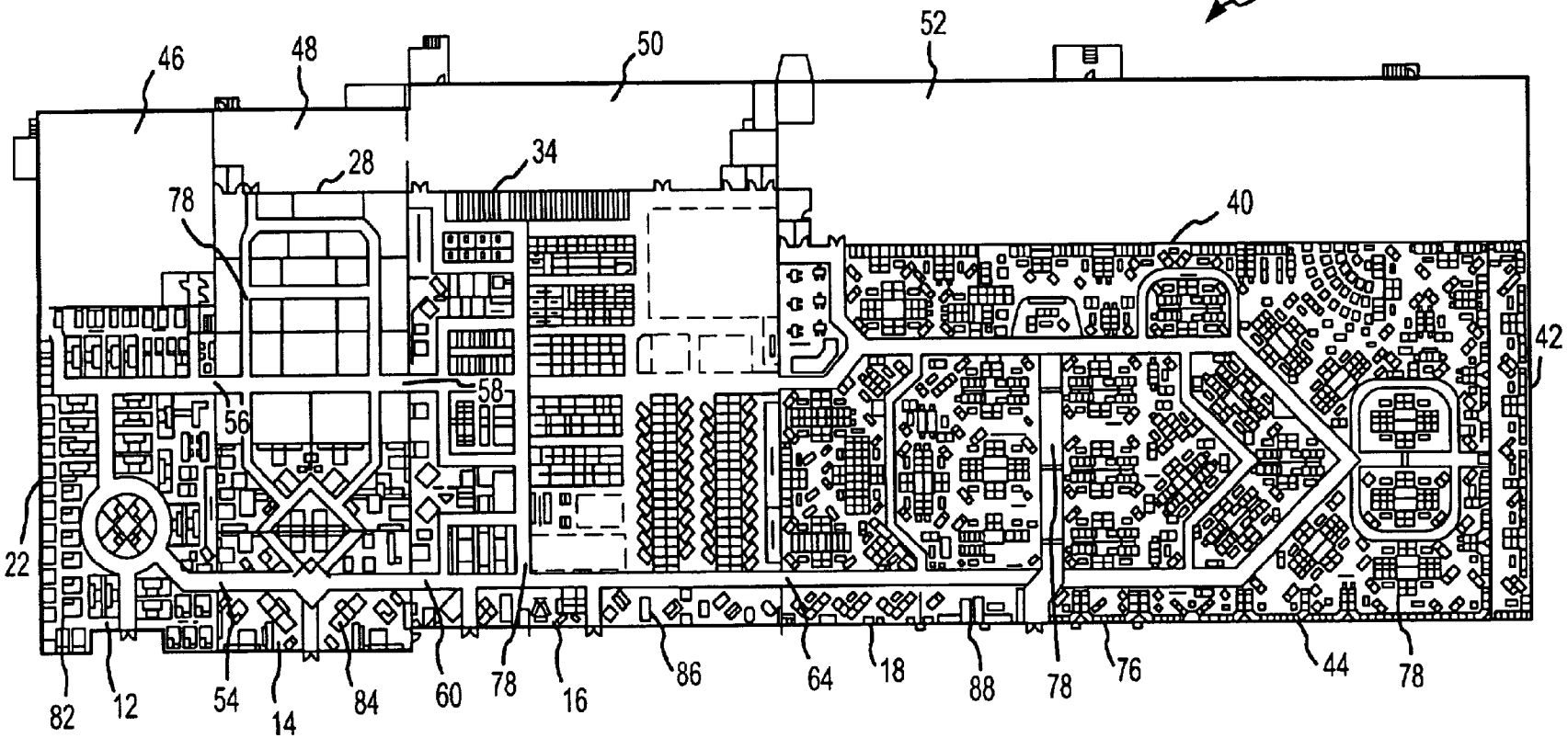
FIG. 3 is a top view of the floor plan of the building of FIG. 2 showing inventory items displayed in each of the stores according to the invention.

Referring now to FIG. 3, building 10 will be described in greater detail. In FIG. 3, stores 12–18 are filled with unique groups of inventory items, with main aisle 76 and mini-aisles 78 being arranged to facilitate the particular arrangement of the inventory items. Stores 12–18 are each provided with a unique group of inventory items 80, 82, 84 and 86. By way of example, group 80 may correspond to Group A of FIG. 1 and include bed mattresses. Group 82 may., correspond to Group B of FIG. 1 and include wood bedroom furniture. Group 84 may correspond to Group C of FIG. 1 and comprise oak furniture. Finally, group 86 may correspond to Group D of FIG. 1 and comprise living room/family room furniture. With this arrangement, stores 12–18 will each have a unique group of inventory items to allow the customer to quickly identify the particular store having a desired item. Once within the appropriate store, the customer may exit main aisle 76 and browse along any of the mini-aisles 78 to find the specific item within the particular group.

Figure 4:
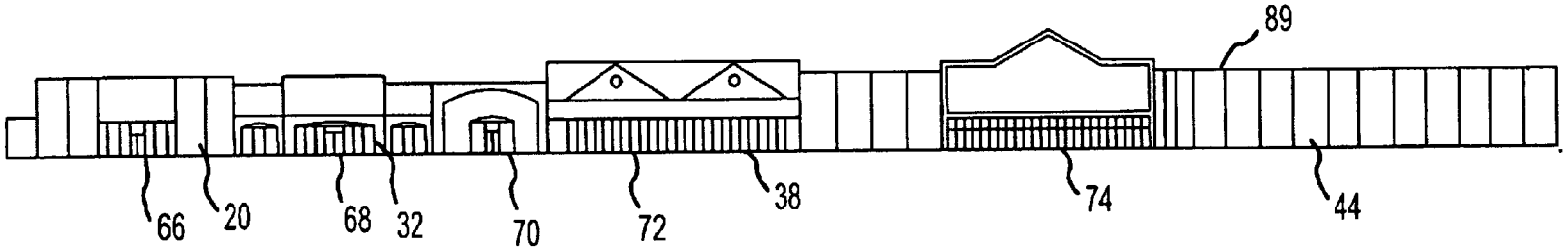
FIG. 4 is a front view of the building of FIG. 3.

Referring to FIGS. 4–7, the exterior of building 10 will be described in greater detail. As shown in FIG. 4, building 10 includes a front 89 which-comprises walls 20, 32, 38 and 44. As previously described, a variety of exterior entrances 66–74 allow access to the stores through front 89. Optionally, portions of front 89 may be constructed of glass to facilitate visualization into the stores. Preferably, a sidewalk or other walkway will pass along front 89 to allow customers to walk externally from store to store. A parking facility will also preferably be included adjacent front 89.

Figure 5:
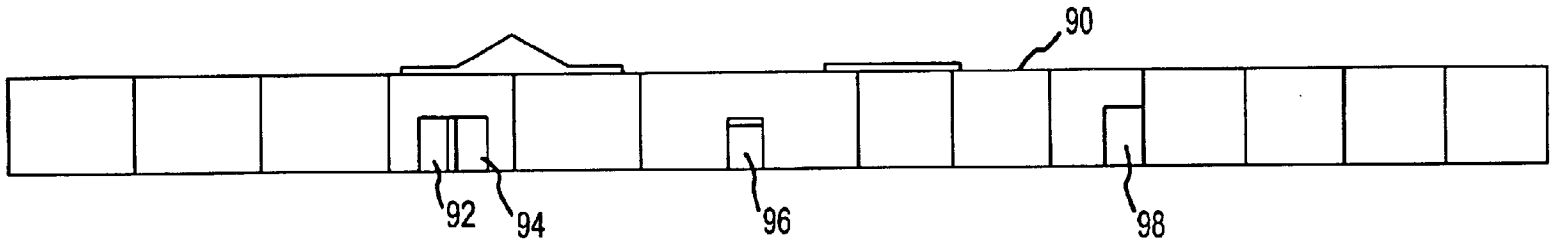
FIG. 5 is a rear view of the building of FIG. 3.
Figure 7:
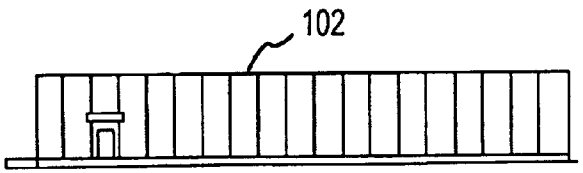
FIG. 7 is a right side view of the building of FIG. 3.
Figure 6:
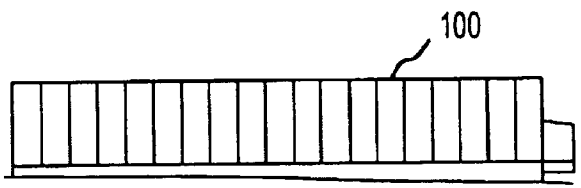
FIG. 6 is a left side view of the building of FIG. 3.

FIG. 5 illustrates a back 90 of building 10 which includes a plurality of doorways 92, 94, 96 and 98 which allow the various inventory items to be moved into warehouses 46, 48, 50 and 52, respectively. FIGS. 6 and 7 illustrate a left-hand side 100 and a right-hand side 102, respectively, of building 10.

Hence, as a customer approaches front 89 as illustrated in FIG. 4, the customer will be presented with a variety of separate stores. Each of the stores includes a separate exterior entrance to allow the customer to enter into any of the stores. When within a particular store, the customer may pass into any of the adjacent stores through main aisle 76 as previously described.

Figure 8:
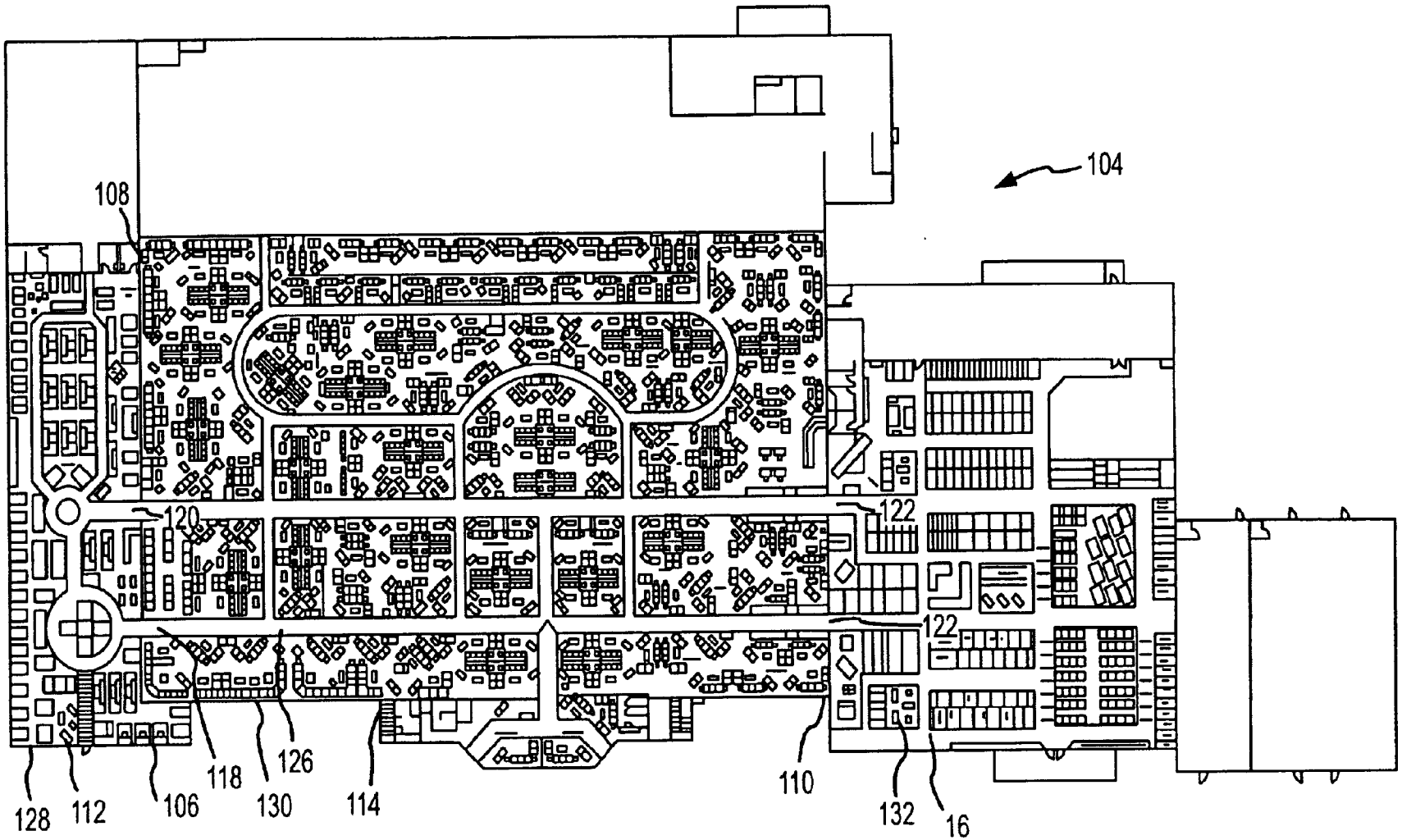
FIG. 8 is a top view of a floor plan of an alternative building having a plurality of separate stores for displaying inventory items according to the invention.

Referring to FIG. 8, an alternative embodiment of a building 104 will be described. Building 104 has a layout which is similar to building 10 and is provided by way of illustration to show that other possible arrangements which are in accordance with the principles of the present invention may be provided. Building 104 comprises an outer structure 106 which is divided by walls 108 and 110 to provide three separate stores 112, 114 and 116. Walls 108 and 110 each include a pair of openings 118, 120, 122 and 124, with opening 120 being aligned with opening 122 and opening 118 being aligned with opening 124. A main aisle 126 circuits through each store through openings 118–124. In this way, a customer may look down aisle 126 to view at least a portion of the interior of each store and may access each of the stores using aisle 126 in a manner similar to that previously described in connection with building 10. Stores 112–116 each include a unique type of inventory items 128, 130 and 132 similar to those previously described in connection with building 10. A plurality of "mini-aisles" 134 are also provided to browse through the various items when within a particular store in a manner similar to that previously described.

Figure 9:
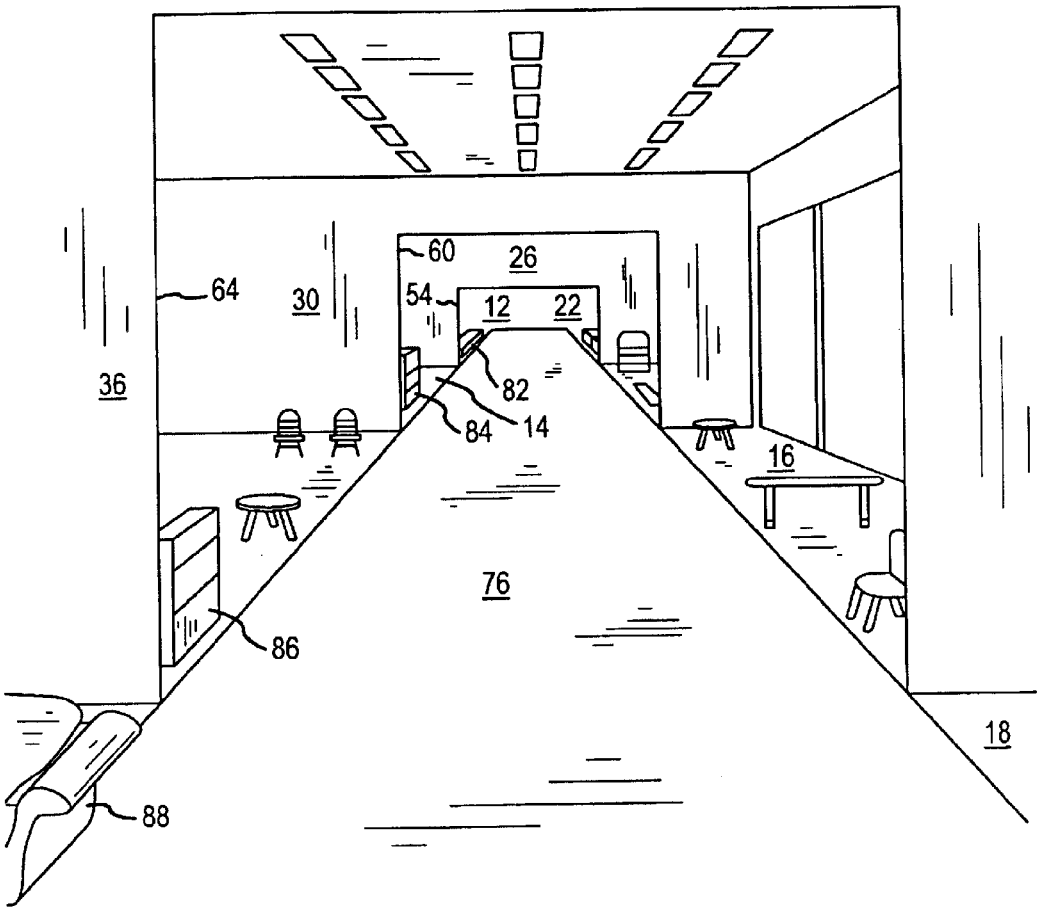
FIG. 9 is a perspective view of a portion of the interior of the building of FIG. 3 when looking down a main aisle according to the invention.

Referring now to FIG. 9, visual access to each of the stores within building 10 from main aisle 76 will be described. FIG. 9 illustrates the view seen by a customer while within store 18 and looking down aisle 76. In this position, the customer is able to view part of the interior of store 18, store 16, store 14 and store 12. Additionally, the customer is able to see a small portion of the inventory items within each store. As shown, the customer is able to see a small portion of groups 88, 86, 84 and 82. With this arrangement, the customer need only to stand in aisle 76 to have visual access to the interior of each of the stores. When locating a particular inventory group, the customer may walk along aisle 76 until within the desired store.

Figure 10:
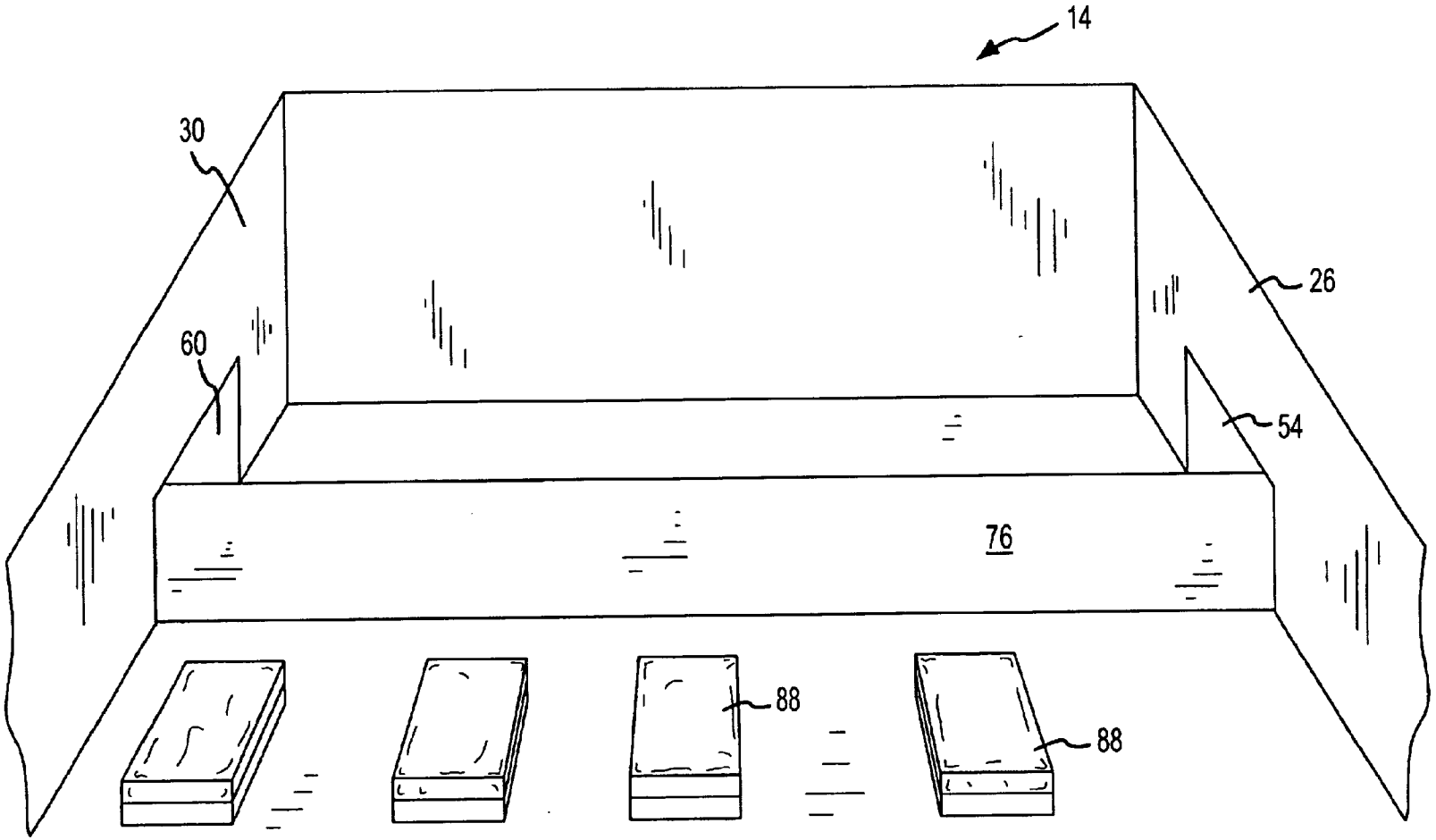
FIG. 10 is a perspective view of a portion of the interior of one of the stores of FIG. 9 when viewed from off of the main aisle according to the invention.

As shown in FIG. 10, once the customer is within a particular store, e.g. store 14, and exits aisle 76, the customer will be able to easily visualize group of items 88 (in this case bed mattresses). Moreover, walls 26 and 30 will generally prevent visual access into the interior of adjacent stores 12 and 16, respectively. Although some visual access will be provided through openings 54 and 60, such openings will preferably be sized to be small enough to prevent any significant visual access into the adjacent stores. In this way, the customer's attention will be focused on only the group of items to which the customer has selected. This will increase the efficiency of the shopper by not having the shopper's attention distracted from other types of items. In the event that the customer does wish to shop for other types of items, the customer may simply reenter main aisle 76 and travel through openings 54 and 60 to enter into adjacent stores. Conveniently, a gate or door may be provided to close openings 54 and 60 during non-operating hours.

Figure 11:
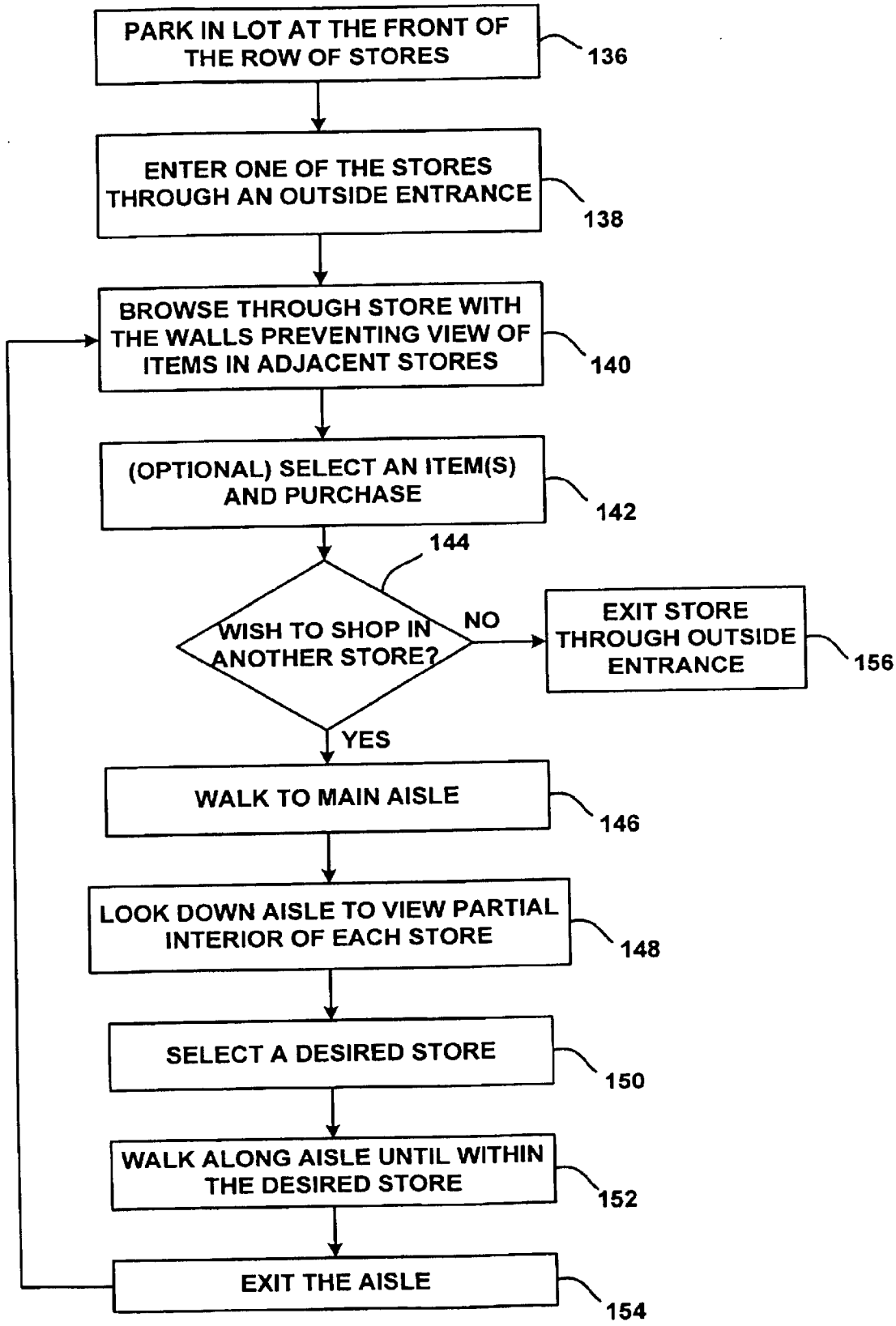
FIG. 11 is a flowchart illustrating an exemplary method for locating inventory items according to the invention.

Referring to FIG. 11, an exemplary method for facilitating the display of various items to enhance sales will be described. Initially, the customer will arrive at the row of stores, preferably in a parking lot at the front of the stores as shown in block 136. The customer will then select one of the stores and enter into that store through an outside entrance as shown in block 138. Once within the selected store, the customer may choose to browse through the store. As the customer goes through the store, the walls will generally prevent a view of items in adjacent stores as shown in block 140. In this manner, the customer may focus his attention only on the items within the selected store. If the customer finds the desired item within the selected store, the customer may purchase the item as shown in step 142. At any time during the shopping experience the customer may wish to enter another store as shown in block 144. To access another store without leaving the building, the customer walks to the main aisle as illustrated in step 146. The customer may then look down the aisle to view the partial interior of each store as shown in step 148. As indicated in step 150, the customer will then select the desired store. Upon the selection, the customer will walk along the main aisle until within the desired store as shown in block 152. The customer then exits the aisle as shown in block 154 and browses through the store as shown in block 140. The customer may repeat this process in as many stores as desired until the customer wishes to finish their shopping experience. At this point, the customer exits the store through the outside entrance as illustrated in step 156.

The invention has now been described in detail. However, it will be appreciated that certain changes and modifications may be made. Therefore, the scope and content of this invention are not limited by the foregoing description. Rather, the scope and content are to be defined by the following claims.

What is claimed is:

1. A system for facilitating the presentation of inventory items, comprising:

at least three separate stores, with each store having at least one separate outside entrance which lead directly to a parking facility to allow customers which park in the parking facility to enter into each of the separate stores through their own outside entrances directly from the parking facility;

an elongate wall separating each store, each wall having a doorway, with the doorways being aligned with each other; and an aisle passing through each doorway such that a customer may visualize at least some of the interior of each store while standing in the aisle and looking down the aisle.

2. A system as in claim 1, wherein the walls generally prevent the visualization of the items within adjacent stores when the customer is away from the aisle.

3. A system as in claim 1, wherein each store includes four outer walls.

4. A system as in claim 3, wherein the walls are orthogonal to each other.

5. A system as in claim 1, wherein each store includes items of a particular type, and wherein the item types for each store are different from each other.

6. A system as in claim 1, wherein each wall includes a pair of doorways, and wherein the aisle circuits through each store while passing through the doorways.

7. A system as in claim 1, wherein each store is independently managed.

8. A system as in claim 1, wherein each doorway includes a door which may be closed to prevent access to the stores from within the stores.

9. A system as in claim 1, further comprising a warehouse connected to at least some of the stores.

10. A building for housing groups of inventory items, the building comprising:

an outer structure defining an interior;

a plurality of elongate dividers within the interior which divide the interior into separate stores, wherein each divider includes a pair of openings therein, wherein the outer structure includes a plurality of external doorways, with each store having its own external doorway, and wherein the external doorways lead directly to a parking facility to allow customers which park in the parking facility to enter into each of the separate stores through their own external doorways directly from the parking facility; and an aisle circuiting the interior and passing through each pair of the openings, wherein a customer may walk along the aisle to circuit through each of the stores.

11. A building as in claim 10, wherein each store includes a unique group of inventory items.

12. A building as in claim 10, wherein the each pair of openings are aligned the other pairs of openings to allow the customer to view at least some of the interior of each store when looking down the aisle.

13. A building as in claim 12, wherein the walls generally prevent the visualization of the items within adjacent stores when the customer is away from the aisle.

14. A building as in claim 10, further comprising a gate which may be placed across each opening to prevent access to adjacent stores from within the stores.

15. A system for visually displaying unique groups of inventory items, the system comprising:

an outer structure having a set of outer walls which define an interior;

a parking facility in front of a front one of the outer walls;

a sidewalk disposed along the front outer wall between the front outer wall and the parking facility;

a plurality of elongate dividers within the interior which divide the interior into at least three separate stores, wherein each divider includes at least one opening therein to allow customers to pass through each of the stores; and wherein each store includes a unique group of inventory items, and wherein the dividers are arranged such that a customer when within the interior can generally visualize only one of the unique groups of items at any given location within the interior, and wherein the unique groups are selected from the groups consisting of bed mattresses, wood bedroom furniture, oak furniture and living room furniture;

wherein each store has at least one separate outside entrance which leads directly to the parking facility after passing over the sidewalk to allow customers which park in the parking facility to enter into each of the separate stores through their own outside entrances directly from the parking facility.

16. A system as in claim 15, further comprising an aisle running through and connecting each opening.

17. A system as in claim 16, wherein the openings are aligned with each other to allow the customer to view at least some of the interior of each store when looking down the aisle.

18. A system as in claim 17, wherein each divider includes a pair of openings, and wherein the aisle circuits through each store while passing through the openings.

* * * * *